US005494365A

United States Patent [19]

Nagae et al.

[11] Patent Number: 5,494,365

[45] Date of Patent: Feb. 27, 1996

[54] TAPE CASSETTE

[75] Inventors: Tuyoshi Nagae, Kasugai; Takamitsu Kawai, Nagoya, both of Japan

[73] Assignee: Brother Kogyo Kabushiki Kaisha, Aichi, Japan

[21] Appl. No.: 270,242

[22] Filed: Jul. 5, 1994

[30] Foreign Application Priority Data

Jul. 7, 1993 [JP] Japan ..... 5-193202

[51] Int. Cl.[6] ..... B41J 29/18

[52] U.S. Cl. ..... 400/703; 400/208

[58] Field of Search ..... 400/207, 208, 400/249, 613, 613.1, 703, 692

[56] References Cited

U.S. PATENT DOCUMENTS

| | | | |
|---|---|---|---|
| 4,605,325 | 8/1986 | Hofmann | 400/208 |
| 4,983,058 | 1/1991 | Nagae | 400/249 |
| 5,290,114 | 3/1994 | Asami et al. | 400/249 |
| 5,352,049 | 10/1994 | Shiraishi et al. | 400/249 |

FOREIGN PATENT DOCUMENTS

| | | |
|---|---|---|
| 0497352A2 | 8/1992 | European Pat. Off. . |
| 0543794A2 | 3/1993 | European Pat. Off. . |
| 2260516 | 4/1993 | United Kingdom . |

*Primary Examiner*—Ren Yan
*Attorney, Agent, or Firm*—Oliff & Berridge

[57] ABSTRACT

A tape cassette for use in a tape printer having a sensor. The tape cassette includes a cassette case with an accommodation space, an exchangeable tape unit having a tape spool and a print tape wound around the tape spool. The exchangeable tape unit is removably receivable in the accommodation space of the cassette case. A tape differentiation member includes a tape spool support and a tape specifier wherein the tape spool support engages with the tape spool so that the tape spool is freely rotatable thereon. The tape specifier specifies a variety of print tape wound around the tape spool by cooperation with the sensor of the tape printer. The tape differentiation member is provided with the tape unit so that the tape differentiation member is exchanged when the tape unit is exchanged.

21 Claims, 6 Drawing Sheets

TAPE CASSETTE

BACKGROUND OF THE INVENTION

1. Field of the Invention

The present invention relates to a tape cassette, used in a tape printer for producing tapes with characters printed thereon, wherein a tape unit with a print tape wrapped on a spool is exchangeable in regards to a cassette case. The present invention relates more particularly to a tape differentiation member for determining, in cooperation with a sensor provided to the tape printer, the variety of tape wrapped on the tape spool.

2. Description of the Related Art

Tapes with characters printed thereon by a tape printer are used for various objectives. A variety of tapes with various tape widths are necessary for meeting these objectives. Conventionally, a variety of tape cassettes are provided, each for supplying one of the various width tapes.

Conventionally a tape width differentiation member that indicates the width tape held in the tape cassette is provided attached to an outer surface of the cassette case. A sensor is provided to the tape printer for detecting the tape width differentiation member and determining the tape width of the tape held in the tape cassette.

However there has been known a problem with the above-described conventional tape cassettes in that when the tape in a tape cassette is used up, the cassette case for holding the tape also loses its value although the cassette case may still be in usable condition. So instead of replacing only the tape, the entire tape cassette is discarded. Discarding the cassette case because the tape is used up is extremely wasteful and is a source of increased running costs for making tapes. Further, considering that normally the cassette case is formed from a resin material such as plastic, discarding the tape cassette merely because the tape is used up conflicts with recent calls for preservation of the environment.

As mentioned above, in order to determine the width of the tape in a tape cassette in a conventional tape printer, a sensor provided to the tape printer detects a tape width differentiation member attached to an outer surface of the cassette case. However, the tape width differentiation member is manually attached to the outer side of each cassette case separate from the actual tape. Therefore, a tape width differentiation member that does not accurately represent the tape width of the tape might be erroneously attached to the cassette case. When such an error is made and the tape width of the tape in the tape cassette does not match the tape width differentiation member attached to the cassette case, accurate printing can not be performed using the printer.

SUMMARY OF THE INVENTION

It is an objective of the present invention to overcome the problems with conventional tape cassettes, and provide a tape cassette wherein a tape unit received therein is exchangeable, wherein the cassette case is effectively used by exchanging the tape differentiation member simultaneously with the tape unit when the tape unit is exchanged, and wherein the combination of tape unit and the tape differentiation member can be provided to the cassette case without error.

In order to achieve the above objectives, a tape cassette according to the present invention for use in a tape printer having a sensor, the tape cassette includes a cassette case with an accommodation space; an exchangeable tape unit having a tape spool and a print tape wound around the tape spool, the exchangeable tape unit being removable receivable in the accommodation space of the cassette case; and a tape differentiation member having a tape spool support and a tape specifier, the tape spool support being for engaging with the tape spool so that the tape spool is freely rotatable thereon, the tape specifier being for specifying a variety of print tape wound around the tape spool by cooperation with the sensor of the tape printer, the tape differentiation member being provided with the tape unit so that the tape differentiation member is exchanged when the tape unit is exchanged.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
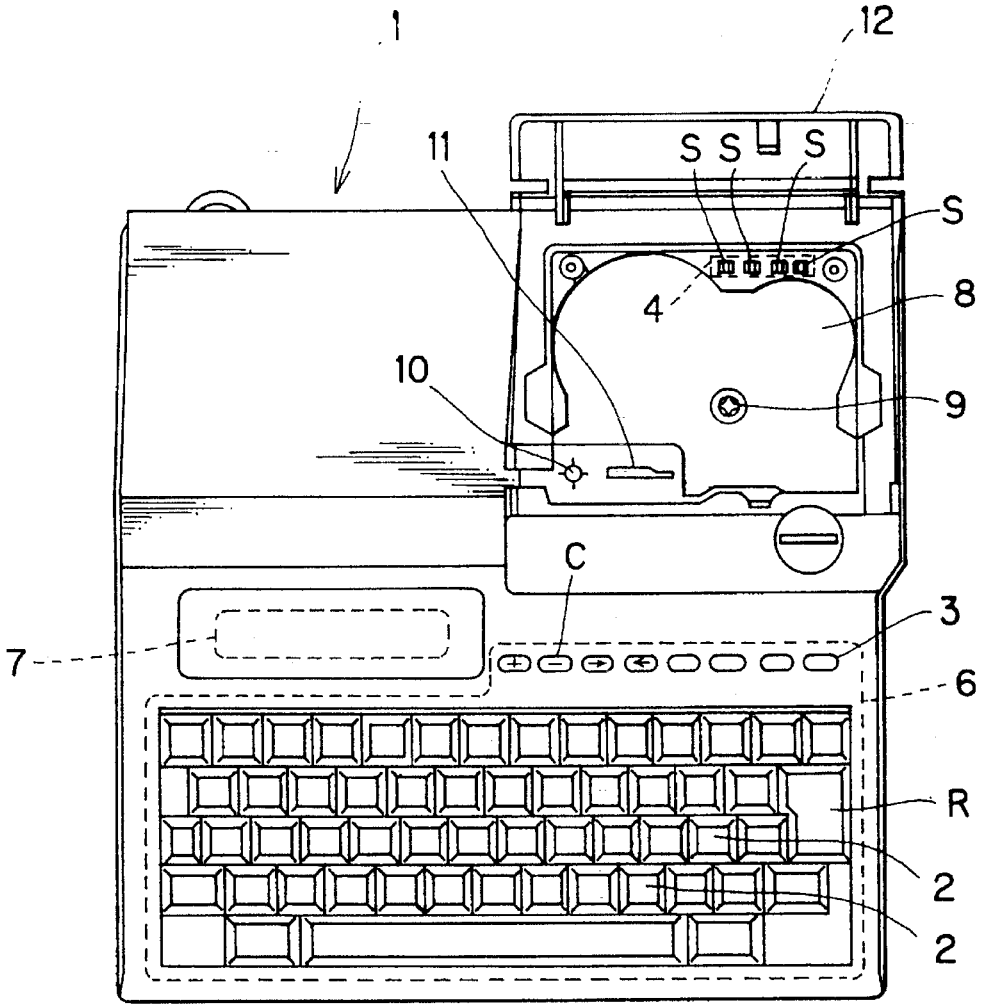
FIG. 1 is a top view showing a printer of a type in which a tape cassette according to the present invention may be used.

A tape cassette according to preferred embodiments of the present invention will be described while referring to the accompanying drawings wherein like parts and components are designated by the same reference numerals to avoid duplicating description. The expressions "left," "right," "front," "rear," "base," "upper", "lower" and the like are used herein to define the various parts when the printer and/or the tape cassette are disposed in an orientation in which they are intended to be used.

Figure 2:
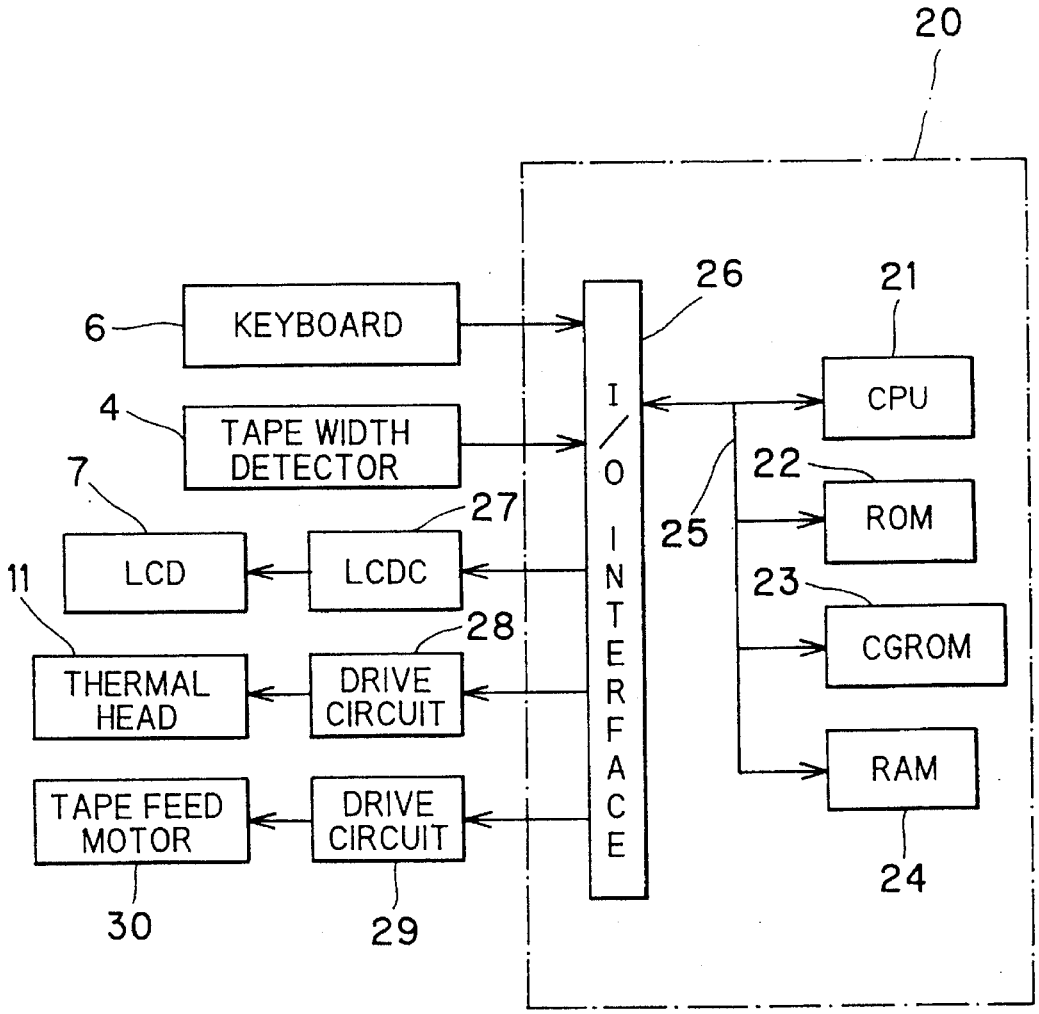
FIG. 2 is a block diagram showing configuration of components of the printer shown in FIG. 1.

First, an explanation of a tape printer with which a tape cassette according to the present invention may be used will be provided while referring to FIGS. 1 and 2.

As shown in FIG. 1, the tape printer includes a keyboard 6 provided with several keys, such as character input keys 2, a print key 3, cursor keys C, and a return key R; a liquid crystal display (LCD) 7 for displaying characters and the like inputted from the keyboard 6; and a cassette receiving portion 8 for receiving a tape cassette 31 according to a first preferred embodiment of the present invention (to be described later). The character input keys 2 are for inputting characters, such as letters, over a plurality of lines to produce text made from text data (code data). The print key 3 is for commanding printing of text. The cursor keys C are for moving the cursor up, down, left, and right, across the LCD 7. The return key R is for commanding hard returns, and for selecting and executing various processes.

An upright ribbon take-up axis 9 is provided to the cassette receiving portion 8. A tape feed motor 30 (refer to FIG. 2) is provided for rotatably driving the ribbon take-up axis 9 via an appropriate drive structure. The ribbon take-up axis 9 is for winding ink ribbon provided in conventional tape cassettes for printing characters on a film tape. However, a tape cassette 31 of the first preferred embodiment is provided with a print tape T for printing characters, and the like, and so does not require ink ribbon. Therefore, the ribbon take-up axis 9 is not involved in the feed operation of the print tape T.

An upright tape feed roller axis 10 for rotating a tape feed roller 42 of the tape cassette 31 is provided in the left front of the ink ribbon take-up axis 9. The tape feed roller 42 is rotated by the tape feed motor 30 via an appropriate transmission structure. Further, a thermal head 11 for performing printing of characters, and the like, on print tape T is fixed at the front portion of the cassette receiving portion 8. A tape width detector 4 is provided in the rear portion of the cassette receiving portion 8 (as shown in the left side of FIG. 1). Four photosensors S are provided to the tape width detector 4. The tape width detector 4 is for detecting the width of a print tape T in a tape unit U. The tape width detector 4 detects the tape width in cooperation with a tape specifier 66 of a tape differentiation member 65 (to be described later) provided with the tape unit U. Each photosensor S is made from a well-known photocoupler having a light-emitting diode paired with a photodetector. Each photosensor S is for detecting whether or not a light-blocking plate 67 of the tape differentiation member 65 is inserted in the photosensor S between the light-emitting diode and the photodetector. Thus, the width of the print tape T can be detected by the combination of the resultant ON/OFF signals. Alternatively, magnetic sensors, mechanical sensors such as microswitches, and the like, can be used for the tape width detector 4.

A cover 12 for covering the cassette receiving portion 8 is pivotably supported to the back of the tape printer 1. When the cover 12 is open as shown in FIG. 1, the tape cassette 31 can be changed.

Next, a further explanation of the structure of the tape printer 1 will be provided while referring to FIG. 2. The tape printer 1 is structured centered on a control unit 20. The control unit 20 includes a central processing unit (CPU) 21, a ROM 22, a CGROM 23 and a RAM 24. A bus 25 is provided to connect these components to each other and to an input/output (I/O) interface 26 of the control unit 20.

The ROM 22 is for storing various programs. Various programs, such as a print control program, necessary for controlling the tape printer 1 are stored in the ROM 22. The CPU 21 is for performing various computations based on the various programs stored in the ROM 22. Outline data that stipulates the contour of each character is stored in the ROM 22 as code data categorized for each font type (for example, gothic font or Ming-cho typeface) and for each of a plurality of characters, such as letters. Dot pattern data based on this outline data is developed in an image buffer.

The CGROM 23 stores dot pattern data which corresponds to each character inputted from the keyboard 6. The dot pattern data is retrieved from the CGROM 23 and a dot pattern based on the dot pattern data is displayed on the LCD 7.

The RAM 24 temporarily stores various computation results computed by the CPU 21. Various memories, such as a text memory, an image buffer, and a print buffer, are provided in the RAM 24.

The input/output interface 26 connects the control unit 20 to the keyboard 6, the tape width detector 4. The input/output interface 26 also connects the control unit 20 to a display controller 27 for controlling the LCD 7, a drive circuit 28 for driving the thermal head 11, and a drive circuit 29 for driving the tape feed motor 30. When characters and the like are inputted via the character input keys 2 of the keyboard 6, the character data is serially stored in the text memory, and dot patterns corresponding to the characters inputted by the keyboard 6 are displayed on the LCD 7 based on a dot pattern generation control program and a display program. The drive circuit 28 drives the thermal head 11 to print dot pattern data sent to the print buffer from the image buffer. The control drive 29 controls the tape feed motor 30 to feed the print tape T in synchronization with printing.

Figure 3:
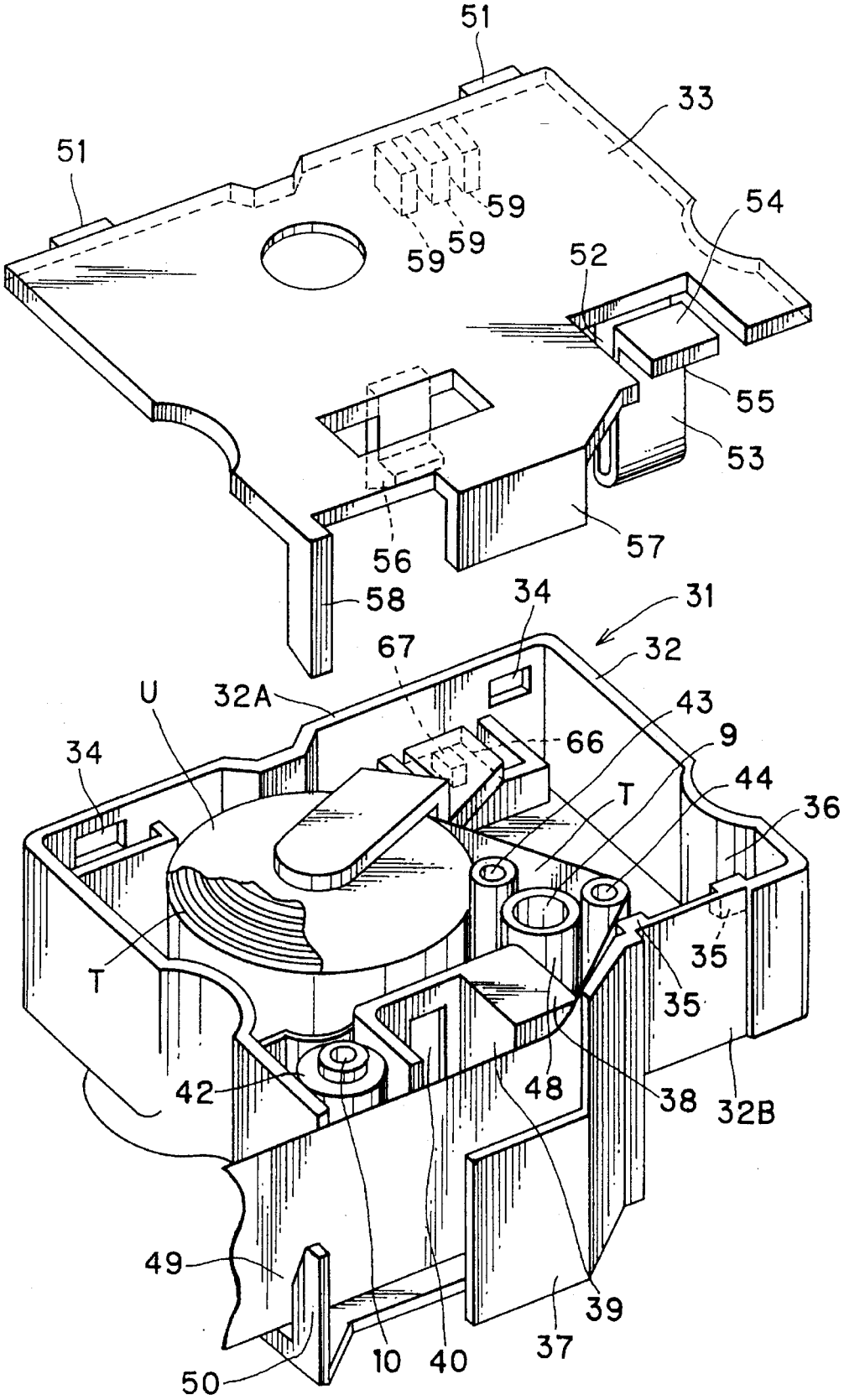
FIG. 3 is a perspective view showing a tape cassette according to a first preferred embodiment of the present invention.
Figure 4:
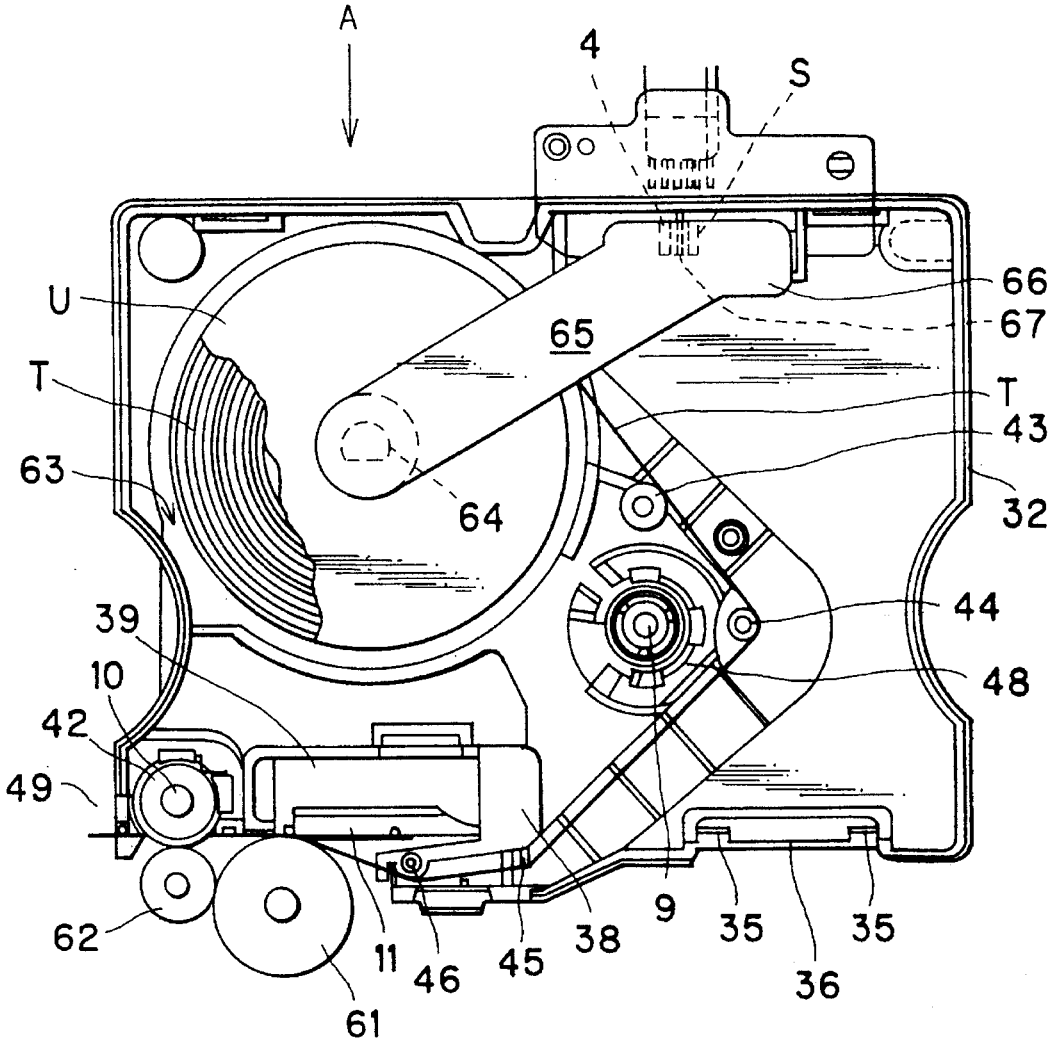
FIG. 4 is a top view showing the tape cassette shown in FIG. 3 received in the printer shown in FIG. 1.

Next, an explanation of the tape cassette 31 for use in the tape printer 1 will be provided while referring to FIGS. 3 and 4. The tape cassette 31 is used received in the cassette receiving portion 8 of the tape printer 1. As shown in FIG. 3, the tape cassette 31 includes a tape cassette case 32 defining an accommodation space, in which a tape unit U and the like are accommodated, and a cassette lid 33 that is detachably provided to the tape cassette case 32 for sealing the accommodation space. The tape cassette case 32 is formed from an open rectangular case having a front wall 32B, a rear wall 32A, a left wall, and a right wall. A pair of lock holes 34 are formed through opposite sides of the rear wall 32A. Each lock hole 34 is for locking with a lock protrusions 51 provided to the cassette lid 33. A pair of protrusions 35 are formed at the right side of the front wall 32B. A lock groove 36 is defined by the protrusions 35. Further, a tape guide plate 37 is provided connected to the right side of the front wall 32B. A thermal head guide member 38 is provided behind the tape guide plate 37. The thermal head guide member 38 is formed in a U-shape as viewed from the top rear of the tape cassette 31. A thermal head 11 is positioned in the U-shaped portion 39. A lock slot 40 is formed to the rear wall of the U-shaped portion 39. Further, an upright tape feed roller 42 is provided between the left side wall of the tape cassette case 32 and the thermal head guide member 38. The tape feed roller 42 is provided so as to be engagable with the tape feed roller axis 10 of the cassette receiving portion 8.

A tape unit receiving portion 63 (refer to FIG. 4) for receiving a tape unit U is provided to the tape cassette case 32 at the left rear thereof. An upright boss 68 is formed to the base wall of the tape cassette case 32. The tape unit U is received in the tape unit receiving portion 63 so as to be rotatable therein on the boss 68. As shown in FIG. 4, the tape unit U includes a print tape T and a tape spool 64 on which the print tape T is wound. The print tape T has a two-surface base tape. A heat-sensitive layer is formed on one surface of a base tape and a peel-off tape is adhered by an adhesive layer to the other. The print tape T is wound onto the tape spool 64 with the heat-sensitive layer facing inward so that discoloration, and the like, of the heat-sensitive layer is prevented.

The tape differentiation member 65 includes an intermediate portion, a cylindrical portion 69 formed at one end of the intermediate portion, and a tape specifier 66 formed to the other end of the intermediate portion. The cylindrical portion 69 is engaged with the boss 68. The tape spool 64 is integrally engaged with the cylindrical portion 69 so that the tape spool 64 is rotatable in regards to the cylindrical portion 69. The tape specifier 66 is for specifying the tape width of a print tape T wound on the tape spool 64. A light-blocking plate 67 for selectively covering each photosensor S in the tape width detector 4 is provided so as to depend horizontally from the lower surface of the tape specifier 66.

Four upright tape guides 43, 44, 45 and 46 (for tape guides 45 and 46 refer to FIG. 4) are provided to the base wall of the tape cassette case 32. The tape guides 43, 44, 45, and 46 are for guiding the print tape T of the tape unit U received in the tape unit receiving portion 63 so that a print tape T drawn from the tape spool 64 of the tape unit U can be smoothly fed to the thermal head 11 by the tape guides 43, 44, 45 and 46.

As mentioned previously, the ribbon drive axis 9 does not participate in the feed operation of the print tape T of the tape cassette 31 according to the present invention. Therefore, a noise-reduction spool 48 for reducing the drive noise generated from the drive structure along with rotation drive of the ribbon drive axis 9 is provided in the cassette case 32 so as to be engagable with the ribbon drive axis 9.

A guide arm 50 is provided extending from the left wall of the tape cassette case 32. A tape discharge portion 49 adjacent to the tape feed roller 42 is defined by the guide arm 50, the left wall of the tape cassette case 32, and a guide arm 58 of the cassette lid 33. The tape discharge portion 49 is for having print tape T discharged therefrom after characters and the like are printed on the print tape T by the thermal head 11.

Next, an explanation of the cassette lid 33 detachably provided to the tape cassette case 32 will be provided while referring to FIG. 3. The cassette lid 33 is for sealing the accommodation space of the tape cassette case 32. A pair of lock protrusions 51 are formed for engaging in the lock holes 34 formed in the tape cassette case 32. An indented area 52 is formed in the right front side of the cassette lid 33. A resilient lock member 55, formed from an elbow 53 and a grip 54, is provided in the indented area 52. The elbow 53 depends downward from the lower surfaoe of the cassette lid 33 before bending upward. The grip 54 is a continuation of the elbow 53 and protrudes horizontally. The position of the resilient lock member 55 and the position of the lock groove 36 correspond so the resilient lock member 55 can resiliently lock in the lock groove 36. Further, a lock arm 56 is provided so as to depend from the lower surface of the cassette lid 33 at the left front side of the cassette lid 33. The position of the lock arm 56 corresponds to the position of the lock slot 40 so that the lock arm 56 can be resiliently locked in the lock slot 40.

A tape guide plate 57 provided depending from the left front tip of the cassette lid 33 is for guiding the print tape T in cooperation with the tape guide plate 37 of the tape cassette case 32 when the cassette lid is attached to the tape cassette case 32. In the same way, the guide arm 58 dependingly provided to the left corner of the cassette lid 33 forms the tape discharge portion 49 in cooperation with the guide arm 50 formed in the tape cassette case 32 when the cassette lid 33 is attached to the tape cassette case 32.

Further, as shown in FIG. 3, three elongated ribs 59 are formed to the left rear edge of the cassette lid 33 so as to depend from the lower surface of the cassette lid 33. The position of the three elongated ribs 59 corresponds to the position of the tape specifier 66.

The following is an explanation of operations for assembling the tape cassette 31 by attaching the cassette lid 33 to the tape cassette case 32 constructed as shown above. First, the lock protrusions 51 of the cassette lid 33 are insertingly engaged into their respective lock holes 34 of the tape cassette case 32. Afterward, the cassette lid 33 is rotated downward with the lock holes 34 acting as hinges. The elbow 53 of the resilient lock member 55 is then resiliently engaged with the lock groove 36 and the lock arm 56 is resiliently locked in the lock slot 40. From this, the cassette lid 33 is engaged with the tape cassette case 32 with a clicking sensation and the tape cassette 31 assembled. When the cassette lid 33 is attached to the tape cassette case 32, the ribs 59 abut the upper surface of the tape specifier 66 and regulate the movement of the tape specifier 66 downward. From this, the tape specifier 66 does not rise from the tape width detector 4 and erroneous detections are prevented.

To remove the cassette lid 33 from the tape cassette 31, the grip 54 of the resilient lock member 55 of the cassette lid 33 is gripped and pulled upward. The lifting movement releases engagement of the elbow 53 from the lock groove 36 and engagement of the lock arm 56 from the lock slot 40 so that the cassette lid 33 can be rotated on the lock holes 34. When the grip 54 is further lifted upward, the cassette lid 33 is rotated upward on the lock holes 34. If the lock protrusions 51 are detached from the lock holes 34 at a suitable position, the cassette lid 33 can be removed from the tape cassette case 32.

Next, an explanation of the tape cassette 31 when received in the cassette receiving portion 8 of the tape printer 1 will be provided while referring to FIG. 4. When the tape cassette 31 is received in the cassette receiving portion 8 of the tape printer 1, the thermal head 11 fixed in the cassette receiving portion 8 is positioned in the U-shaped portion 39 of the thermal head guide member 38. Here, the thermal head 11 becomes positioned facing the interior of the tape cassette 31. Because of this and because, as described previously, the print tape T is wrapped around the tape spool 64 so that the heat-sensitive layer faces inward, the plurality of thermal elements provided to the thermal head 11 will confront and contact the heat-sensitive layer of the print tape T.

A roller holder (not shown) is rotatably provided to the cassette receiving portion 8 so as to confront the thermal head 11 and the tape feed roller 42. A platen roller 61 is rotatably supported on the roller holder so as to confront the thermal head 11. A tape feed assist roller 62 is rotatably supported so as to confront the tape feed roller 42. When the tape printer 1 is operated, the platen roller 61 is abutted by the thermal head 11 and the tape feed assist roller 62 is abutted by the tape feed roller 42. Thus, a print tape T drawn from the tape spool 64 of the tape unit U received in the tape unit receiving portion 63 of the tape cassette case 32 is smoothly guided through the tape guides 43 through 45 by cooperative movement of the tape feed roller 42 and the tape feed assist roller 62 while characters such as letters are printed on the heat-sensitive layer of the print tape T by cooperation between the thermal head 11 and the platen roller 61. Afterward, the print tape T with characters printed thereon is discharged out of the tape printer 1 from the tape discharge portion 49 by cooperation between the tape feed roller 42 and the tape feed assist roller 6

Figure 6:
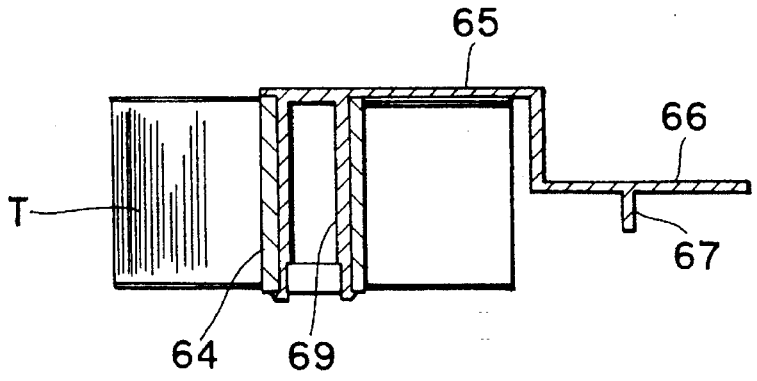
FIG. 6 is a cross-sectional view showing a tape differentiation member and a tape unit according to the first preferred embodiment of the present invention.
Figure 5:
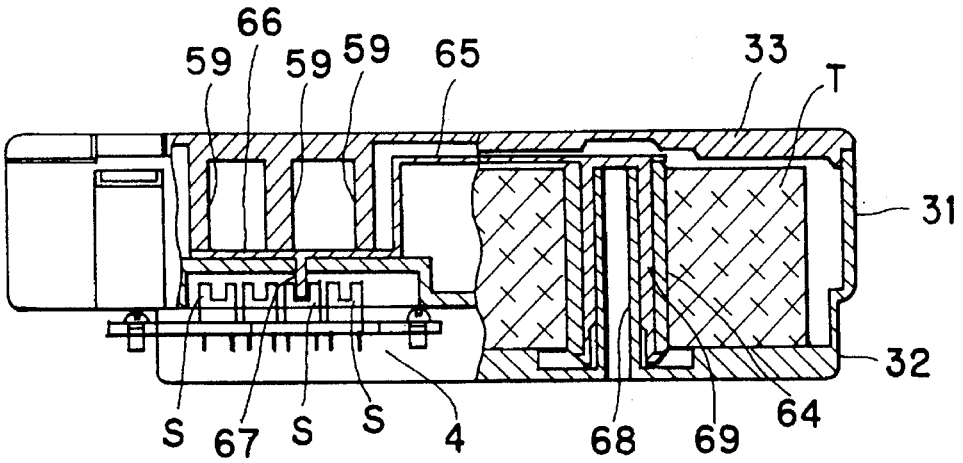
FIG. 5 is a partially cross-sectional view showing the tape cassette shown in FIG. 3.

Next, an explanation of the structure for detecting the tape width of the print tape T that is wrapped on the tape spool 64 will be provided while referring to FIGS. 5 and 6. As mentioned above, the cylindrical portion 69 is provided so as to depend from the tip of the lower surface of the tape differentiation member 65 and the cylindrical portion 69 is engaged with the boss 68. The tape spool 64 is attached so as to be rotatable in regards to the tape differentiation member 65. When the tape cassette 31 is received in the cassette receiving portion 8, the light-blocking plate 67 depending from the lower surface of the tape specifier 66 selectively covers the photosensors S of the tape width detector 4. The tape differentiation member 65 detects the tape width of the print tape T wrapped on the tape spool 64 based on the ON/OFF signals outputted from the photosensors S. Because downward movement of the tape specifier 66 is regulated by the ribs 59 extending from the lower surface of the cassette lid 33, the light-blocking plate 67 accurately covers the photosensors S and erroneous detection is prevented. In this way the width of the tape is detected by the photosensors S, positioned in the tape width detector 4 of the cassette receiving portion 8 of the tape printer 1, and the light-blocking plate 67, of the tape specifier 66 of the tape differentiation member 65. Although only one light-blocking plate 67 is provided in the first preferred embodiment, by providing a maximum of four light-blocking plates 67 in regards to the four photosensors S, detection of the tape width of 16 varieties of print tape T using a composite four bit ON/OFF signal from the four sensors.

As described previously, characters and the like are printed on the heat-sensitive layer of the print tape T and a tape with characters is produced. When print tape T wound to the tape spool 64 runs out, the tape spool 64 can be replaced with a tape unit U with a new unused print tape T. In this case, first the tape cassette 31 is removed from the cassette receiving portion 8 and the cassette lid 33 is detached from the tape cassette case 32 following the above-described procedure. Next, the empty tape spool 64 is removed from the tape unit receiving portion 63 and a new tape unit U with an unused print tape T wound thereon is inserted into the tape unit receiving portion 63. Because the tape differentiation member 65 is integratedly attached to the tape spool 64, the tape differentiation member 65 is exchanged simultaneously with the tape unit U when the tape unit U is exchanged. Therefore, using an improper tape differentiation member 65 with the tape unit U is prevented. The tape differentiation member 65 will always represent the tape width of the print tape T wrapped around the tape spool 64 of the tape unit U.

The print tape T is guided to the tape feed roller 42 via the tape guides 43 through 46. By this, the tape unit U is set in the tape cassette case 32. Afterward, the tape cassette 31 is assembled by attaching the cassette lid 33 to the tape cassette case 32 following the above-described procedures. When the tape cassette 31 is mounted in the cassette receiving portion 8 of the tape printer 1, characters can again be printed on the print tape T using the thermal head 11. When a tape with characters is produced from a print tape T, the width of the print tape T in the tape unit U in the tape cassette 31 can be detected by the photosensors S of the tape width detector 4 and the light-blocking plate 67 of the tape differentiation member 65. The tape printer 1 performs printing and the like, as controlled by the CPU 21, corresponding to the print tape T with the detected width.

Figure 7:
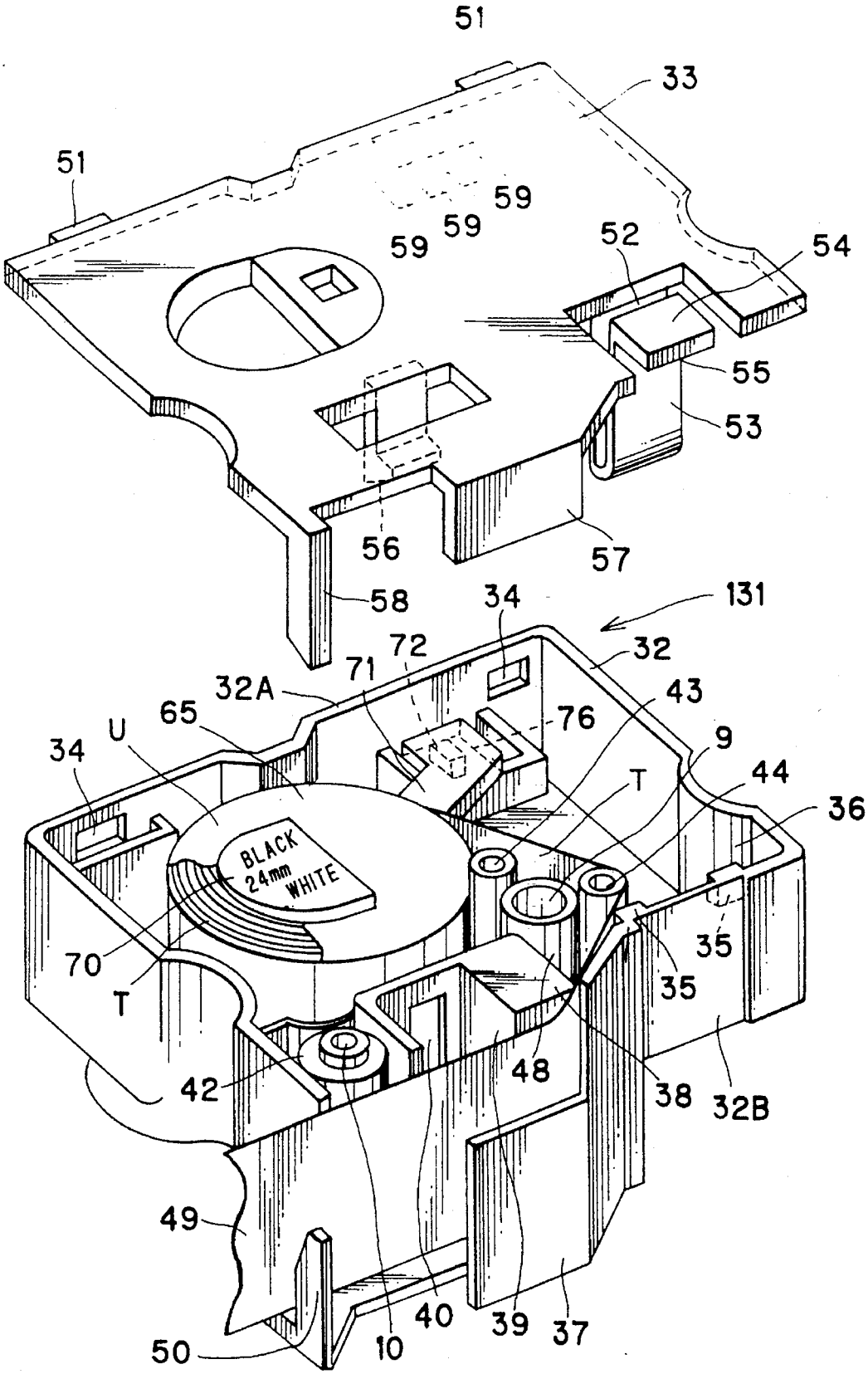
FIG. 7 is a perspective view showing a tape cassette according to a second preferred embodiment of the present invention.
Figure 8:
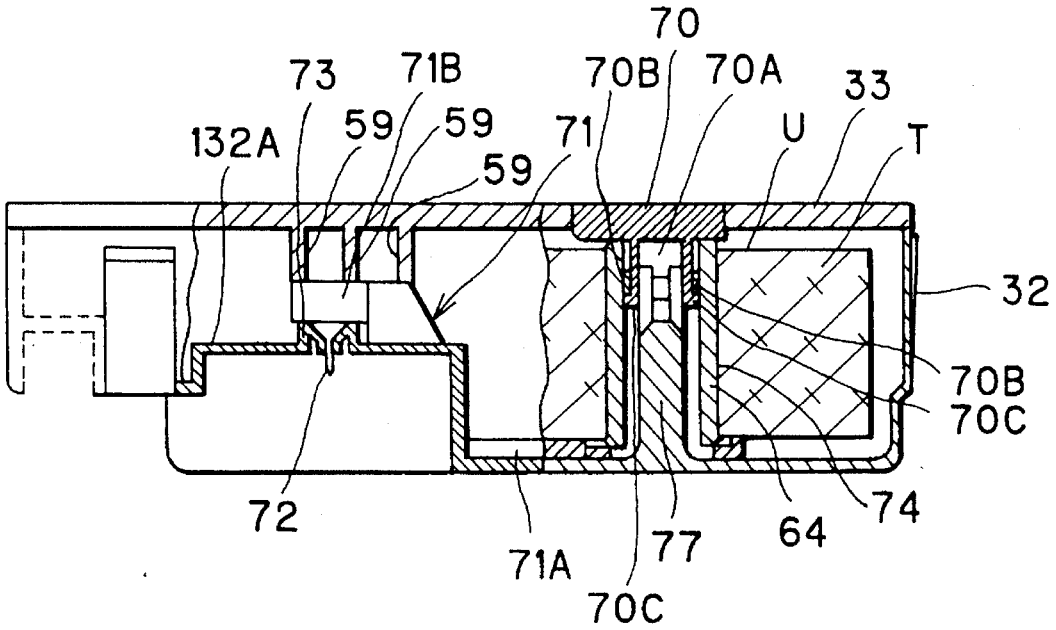
FIG. 8 is a partially cross-sectional view showing the tape cassette shown in FIG. 7.
Figure 9:
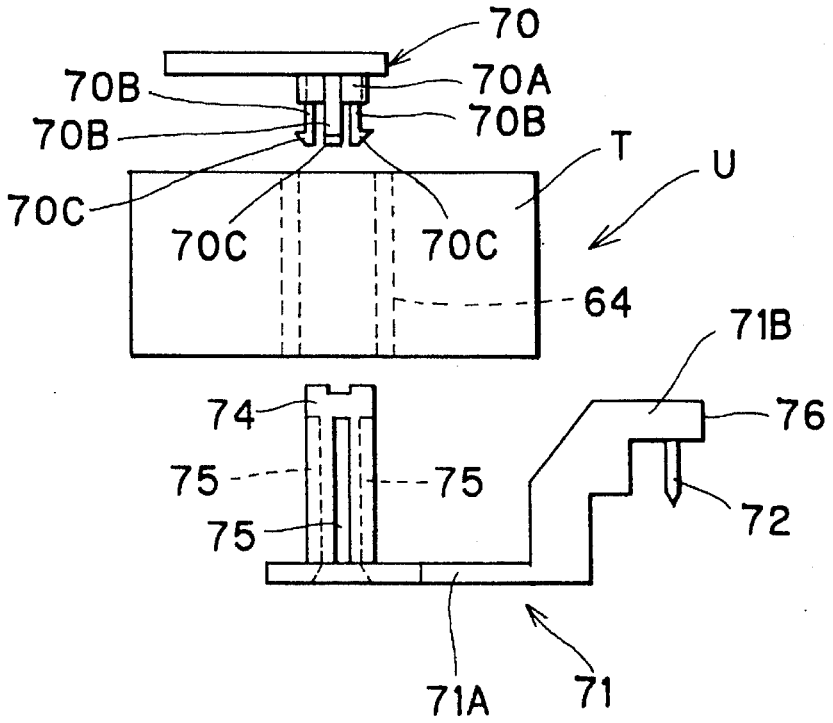
FIG. 9 is a cross-sectional view showing a tape differentiation member and a tape unit according to the second preferred embodiment of the present invention.

Next, an explanation of a tape differentiation member 71 according to a second preferred embodiment of the present invention will be provided while referring to FIGS. 7 through 9. The tape cassette 131 in which the tape differentiation member of the second preferred embodiment is mounted has basically the same structure as the tape cassette 31 of the first preferred embodiment. Accordingly, the components and the like that are similar to those in the tape cassette 31 are given the same numbering. The following explanation will deal mainly with points that differ between the tape cassette 31 and the tape cassette 131 of the second preferred embodiment. Although the tape differentiation member 65 crossed the upper surface of the tape unit U, the tape differentiation member 71 is positioned across the lower surface of the tape unit T.

As shown in FIG. 9, the tape differentiation member 71 includes a horizontal portion 71A, an inclined portion 71B, and a rotation support portion 74 integrally formed to each other. When the tape unit U is engaged in the tape cassette case 32, the horizontal portion 71A is mounted on the base wall of the tape cassette case 32 below the tape spool 64.

The rotation support portion 74 is provided to one end of the horizontal portion 71A so as to have an upright posture. Lock grooves 75 are formed in rotation support member 74. The spool 64 of the tape unit U is rotatably engaged with the rotation support portion 74.

A cap member 70 with a protrusion 70A formed to the lower surface thereof is provided with its protrusion 70A engaged to the top portion of the tape spool 64 of the tape unit U. As shown in FIG. 7, information relating to the width of the print tape T and to the color of characters, and the like, that will be thermally formed on the heat-sensitive layer of the print tape T wound on the tape spool 64 are indicated on the top surface of the cap member 70. Four resilient lock arms 70B are provided to the protrusion 70A so as to depend downward from the protrusion 70A. A lock protrusion 70C is formed to the lower tip of each resilient lock arm 70B so as to protrude radially outward. The lock protrusions 70C resiliently engage with the lock grooves 75 formed in the rotation support member 74 of the tape differentiation member 71. By this, the cap member 70 and the tape differentiation member 71 can be connected within the tape spool 64.

The inclined portion 71B rises at an incline from the other end of the horizontal portion 71A. A tape width specifying portion 76 is formed to the inclined portion 71B. A light-obstructing plate 72 is provided depending form the lower surface of the tape width specifying portion 76. The light-obstructing plate 72 selectively covers photosensors S of the tape width detector 4 (not shown in diagrams for the second preferred embodiment).

A tape width detection portion 132A is provided to the base wall of the tape cassette case 32. The tape width detector 4 is positioned beneath tape width detection portion 132A. A positioner 73 for positioning the light-obstructing plate 72 is formed to the tape width detection portion 132A. The light-obstructing plate 72 is positioned by the positioning member 73 so as to accurately obstruct light from being incident on the photosensor S of the tape width detector 4.

Detection of the tape width of the print tape T wound on the tape spool 64 based on ON/OFF signals outputted from the photosensors S in the tape width detector 4 is the same as previously described for the tape differentiation member 65. In the same way as described above, the lower tips of the three ribs 59 depending from the cassette lid 33 abut the upper surface of the tape width specifying portion 76 in the inclined portion 71B (refer to FIG. 8). By this, upward movement of the tape width specifying portion 76 is regulated by the ribs 59 so that erroneous detection caused by the tape width specifying portion 76 lifting from the tape width detector 4 is effectively prevented.

Further, the rotation support portion 74 is formed with a cylindrical shape. Four lock grooves 75 are provided vertically in four places around the rotation support portion 74. A lock protrusion 70C of each resilient lock arm 70B formed to the cap member 70 is resiliently locked in its respective lock groove 75 as described previously. The resilient arms 70B and the rotation support member 74 are freely engaged within the tape spool 64. Because of this, the tape spool 64 is rotatably supported mainly via the rotation support member 74. The tape spool 64 becomes integrally constructed with the cap member 70 and the rotation support member 74 and, by this, the tape differentiation member 71 and the tape spool 64 are always handled as a single unit. Further, a support axis 77 for engaging with the rotation support member 74 structured as described above is provided to the base wall of the tape cassette case 32 so as to have an upright posture (refer to FIG. 8).

When the print tape T wound on the tape spool 64 is used up, the tape spool 64 can be replaced by a tape unit U with a new unused print tape wrapped thereon. In this case, first, the tape cassette 31 is removed from the cassette receiving portion 8 and the cassette lid 33 is detached from the tape cassette case 32 by following the procedures described in the first preferred embodiment. Next, the empty tape spool 64 is removed from the tape unit receiving portion 63 and a new exchange tape unit U with an unused print tape T wrapped thereon is received into tape unit receiving portion 63. At this time, the tape differentiation member 71 is integrally attached to the tape spool 64 so as to be rotatable in regards to the tape spool 64. Accordingly, when a tape unit U is exchanged, that tape unit U and the tape differentiation member 71 are also exchanged simultaneously. By this, providing a tape unit U and a tape differentiation member 71 that are different from each other to the tape cassette 31 can be effectively prevented. Therefore, the tape width of the print tape T wrapped on the tape spool 64 of the tape unit U and the tape unit U will always match.

The print tape T is guided to the tape feed roller 42 via the tape guides 43 through 46. By this, the exchange tape unit U is set in regards to the tape cassette case 32. Afterward, the tape cassette 31 is assembled by attaching the cassette lid 33 to the tape cassette case 32 following the procedures described in the first preferred embodiment. By mounting the tape cassette 31 into the cassette receiving portion 8 of the tape printer 1, printing of characters and the like on the print tape can again be performed via the thermal head 11. When characters and the like are printed on the print tape T, the photosensors S of the tape width detector 4 and the light-obstructing plate 72 of the tape differentiation member 71 detect the tape width of the print tape in the tape unit U in the tape cassette 31. Therefore, the tape printer 1 is controlled by the CPU 21 to print on print tape T according to the detected tape width.

As explained in detail above, in a tape cassette 31 according to the preferred embodiments the tape unit U is replaceable in regards to the tape cassette case 32. Also, the tape differentiation members 65 and 71 for indicating the tape width of the print tape T wrapped on the tape spool 64 are integrally attached to the tape spool 64 of the tape unit U so as to be rotatable. Therefore, the tape unit U and the tape differentiation members 65 and 71 are always handled as a single unit so that the tape differentiation members 65 and 71 are exchanged with the tape unit U. This allows effective use of the tape cassette case 32 and the cassette lid 33 so that running costs are reduced. Also, mismatched tape units U and tape differentiation members 65 and 71 will not be erroneously assembled together. Therefore, the tape unit U can always be set in the tape cassette 31 so that the print tape T wrapped on the tape spool 64 of the tape unit U and the tape width indicated by the tape differentiation members 65 and 71 match.

While the invention has been described in detail with reference to specific embodiments thereof, it would be apparent to those skilled in the art that various changes and modifications may be made therein without departing from the spirit of the invention.

What is claimed is:

1. A tape cassette for use in a tape printer, the tape printer having a sensor, the tape cassette comprising:

a cassette case with an accommodation space;

an exchangeable tape unit having a tape spool and a print tape wound around the tape spool, the exchangeable tape unit being removably receivable in the accommodation space of the cassette case; and a tape differentiation member having a tape spool support and a tape specifier, the tape spool support engaging the tape spool so that the tape spool is freely rotatable thereon, the tape specifier specifying a variety of print tape wound around the tape spool by cooperation with the sensor of the tape printer, the tape differentiation member being provided with the tape unit so that the tape differentiation member is exchanged when the tape unit is exchanged and wherein said tape spool support includes means for preventinq relative movement between the tape spool and the tape spool support along an axial direction of the tape spool.

2. A tape cassette as claimed in claim 1 wherein the cassette case has a base wall to which a support axis is formed and wherein the tape spool support has a hollow cylindrical shape with an opening end and another end, an opening being formed in the opening end of the tape spool support, the tape spool support being capable of engaging the support axis therein through the opening in the opening end thereof.

3. A tape cassette as claimed in claim 2 wherein the tape differentiation member further has an intermediate member having a support end to which the another end of the tape spool support is attached.

4. A tape cassette as claimed in claim 2 wherein the tape differentiation member further has an intermediate member having a support end to which the opening end of the tape spool support is attached.

5. A tape cassette as claimed in claim 4 wherein the preventing means includes a cap for preventing the tape spool from disengaging from the tape spool support, the cap being engagable with the another end of the tape spool support.

6. A tape cassette as claimed in claim 5 wherein the preventing means includes grooves formed at the another end of the tape spool support, and wherein the cap has locking arms for engaging with the grooves of the tape spool support.

7. A tape cassette as claimed in claim 1 wherein the tape differentiation member further has an intermediate member having a support end to which the tape spool support is provided and a specifier end to which the tape specifier is provided.

8. A tape cassette as claimed in claim 7 wherein the tape specifier includes an obstructing element for being inserted into an opening of the sensor.

9. A tape cassette as claimed in claim 8 wherein the cassette case has a base wall to which a support axis is formed, and wherein the tape spool support has a hollow cylindrical shape with an opening end and another end, an opening being formed in the opening end of the tape spool support, the tape spool support being capable of engaging the support axis therein through the opening in the opening end thereof, the another end of the tape spool support being attached to the support end of the intermediate member.

10. A tape cassette as claimed in claim 8 wherein the cassette case has a base wall to which a support axis is formed, and wherein the tape spool support has a hollow cylindrical shape with an opening end and another end, an opening being formed in the opening end of the tape spool support, the tape spool support being capable of engaging the support axis therein through the opening in the opening end thereof, the opening end of the tape spool support being attached to the support end of the intermediate member.

11. A tape cassette as claimed in claim 10 wherein the preventing means includes a cap for preventing the tape spool from disengaging from the tape spool support, the cap being engagable with the another end of the tape spool support.

12. A tape cassette as claimed in claim 11 wherein the preventing means include grooves formed at the another end of the tape spool support, and wherein the cap has locking arms for engaging with the grooves of the tape spool support.

13. A tape cassette as claimed in claim 8 further comprising a cassette lid for engaging with the cassette case to seal the accommodation space, a securing member being formed to the cassette lid, the securing member being for preventing the obstructing element of the tape specifier from pulling out of the opening of the sensor.

14. A tape cassette as claimed in claim 13 wherein the securing member is a rib member which presses against the tape specifier when the cassette lid is engaged with the cassette case.

15. A tape cassette as claimed in claim 1 wherein the tape specifier specifies at least a width of the print tape wound around the tape spool.

16. A tape printer and a tape cassette detachably loaded therein, the tape printer comprising a sensor, the tape cassette comprising:

a cassette case with an accommodation space;

an exchangeable tape unit having a tape spool and a print tape wound around the tape spool, the exchangeable tape unit being removably receivable in the accommodation space of the cassette case; and a tape differentiation member having a tape spool support and a tape specifier, the tape spool support engaging the tape spool so that the tape spool is freely rotatable thereon, the tape specifier specifying a variety of print tape wound around the tape spool by cooperation with the sensor of the tape printer, the tape differentiation member being provided with the tape unit so that the tape differentiation member is exchanged when the tape unit is exchanged and wherein said tape spool support includes means for preventing relative movement between the tape spool and tape spool support along an axial direction of said tape spool.

17. A tape cassette as claimed in claim 16 wherein the tape specifier specifies at least a width of the print tape wound around the tape spool.

18. A tape cassette as claimed in claim 16 wherein the sensor detects information specified by the tape specifier on at least a width of the print tape wound around the tape spool, the printer performing tape printing operations based on the information.

19. A tape cassette as claimed in claim 16 wherein the cassette case has a base wall to which a support axis is formed and wherein the tape spool support has a hollow cylindrical shape with an opening end and another end, an opening being formed in the opening end of the tape spool support, the tape spool support being capable of engaging the support axis therein through the opening in the opening end thereof.

20. A tape cassette for use in a tape printer, the tape printer having a sensor, the tape cassette comprising:

a cassette case with an accommodation space;

an exchangeable tape unit having a tape spool and a print tape wound around the tape spool, the exchangeable tape unit being removably receivable in the accommodation space of the cassette case; and a tape differentiation member having a tape spool support having an exterior surface and a tape specifier, the tape spool support engaging the tape spool so that the tape spool is freely rotatable around the exterior surface of the tape spool support, the tape specifier specifying a variety of print tape wound around the tape spool by cooperation with the sensor of the tape printer, the tape differentiation member being provided with the tape unit so that the tape differentiation member is exchanged when the tape unit is exchanged.

21. A tape printer and a tape cassette detachably loaded therein, the tape printer comprising a sensor, the tape cassette comprising:

a cassette case with an accommodation space;

an exchangeable tape unit having a tape spool and a print tape wound around the tape spool, the exchangeable tape unit being removably receivable in the accommodation space of the cassette case; and a tape differentiation member having a tape spool support having an exterior surface and a tape specifier, the tape spool support engaging the tape spool so that the tape spool is freely rotatable around the exterior surface of the tape spool support, the tape specifier specifying a variety of print tape wound around the tape spool by cooperation with the sensor of the tape printer, the tape differentiation member being provided with the tape unit so that the tape differentiation member is exchanged when the tape unit is exchanged.

* * * * *